US006224408B1

(12) United States Patent
Wu

(10) Patent No.: US 6,224,408 B1
(45) Date of Patent: May 1, 2001

(54) AUDIO JACK

(75) Inventor: Kun-Tsan Wu, Tu-Chen (TW)

(73) Assignee: Hon Hai Precision Ind. Co. Ltd., Taiepi Hsien (TW)

( * ) Notice: Subject to any disclaimer, the term of this patent is extended or adjusted under 35 U.S.C. 154(b) by 0 days.

(21) Appl. No.: 09/293,597

(22) Filed: Apr. 16, 1999

(30) Foreign Application Priority Data

Oct. 17, 1998 (TW) ..... 87217146

(51) Int. Cl.[7] ..... H01R 29/00
(52) U.S. Cl. ..... 439/188; 439/910
(58) Field of Search ..... 439/83, 188, 668, 439/581

(56) References Cited

U.S. PATENT DOCUMENTS 5,075,518 * 12/1991 Matsumoto ..... 439/188
5,338,215 * 8/1994 Lee et al. ..... 439/188
5,919,052 * 7/1999 Ho ..... 439/83

* cited by examiner

*Primary Examiner*—Khiem Nguyen
*Assistant Examiner*—J. F. Duverne
(74) *Attorney, Agent, or Firm*—Wei Te Chung

(57) ABSTRACT

An audio jack includes a casing 6 defining an interior space 620. Two sets of slots are formed on a top face 60 of the casing 6 in communication with the interior space 620 for receiving and retaining conductive terminal members therein, including two stationary members 3, 4 and two associated movable members 1, 2. The movable members 1, 2 engage with the stationary members 3, 4 and are selectively disengageable therefrom. The conductive terminal members 1, 2 3 and 4 are pre-compressed before being fit into the slots and the reactive spring force thereof retains the terminal members 1, 2, 3 and 4 in position inside the slots 601, 602, 603 and 604. A plug receptacle 7 is formed on the casing member 6 for reception of a plug that is inserted into the interior space 620. When the plug is inserted into the interior space 620 physical/electrical engagements is established with the movable members 1, 2 and the movable members 1, 2 are force to disengage from the stationary members 3 and 4. The bottom face 61 of the casing 6 is provided with openings 631 and 632 that allow a user to visually observe the terminal members.

9 Claims, 7 Drawing Sheets

AUDIO JACK

BACKGROUND OF THE INVENTION

1. Field of the Invention

The present invention generally relates to an electrical connector, and in particular to an audio jack type connector for transmitting audio signals.

2. The Prior Art

Conventional audio jacks usually comprise an insulative casing defining a top opening and an interior space for accommodating a number of conductive terminal members therein. An insulative cover is fixed to the casing to seal the top opening and to fix the terminal members in position. Each conductive terminal member comprises resilient sections that undergo deformation when contacted by a plug inserted into the interior space. Examples of conventional audio jacks are disclosed in Japanese patent publication No. 5-90863 and Taiwan patent application No. 80203161.

However, in such conventional designs, the conductive terminal members are not securely retained in position, especially during insertion of the plug. Thus, intermittent audio signal transmission may result. In addition, conventional audio jacks provide no means for a user to observe and detect disconnection of the terminal members. It is thus desirable to have an audio jack that effectively secures the terminal members in position and also allows the user to observe the terminal members.

SUMMARY OF THE INVENTION

Accordingly, an object of the present invention is to provide an audio jack having a structure for effectively securing terminal members in position thereby maintaining proper engagement between the terminal members and providing a continuous transmission of audio signals.

Another object of the present invention is to provide an audio jack having a casing provided with observing windows for a user to visually inspect the terminal members for the detection of disconnection points therebetween.

To achieve the above objects, an audio jack in accordance with the present invention comprises a casing defining an interior space. Two sets of slots are formed on a top face of the casing in communication with the interior space for receiving and retaining conductive terminal members therein, including two stationary members and two associated movable members. The movable members engage with the stationary members and are selectively disengageable therefrom. The conductive terminal members are pre-compressed before being fit into the slots and the reactive spring force thereof retains the terminal members in position inside the slots. A plug receptacle is formed on the casing member for reception of a plug that is insertable into the interior space. When the plug is inserted into the interior space physical/electrical engagement is established with the movable members and the movable members are forced to disengage from the stationary members. The bottom face of the casing is provided with openings that allow a user to visually observe the terminal members.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
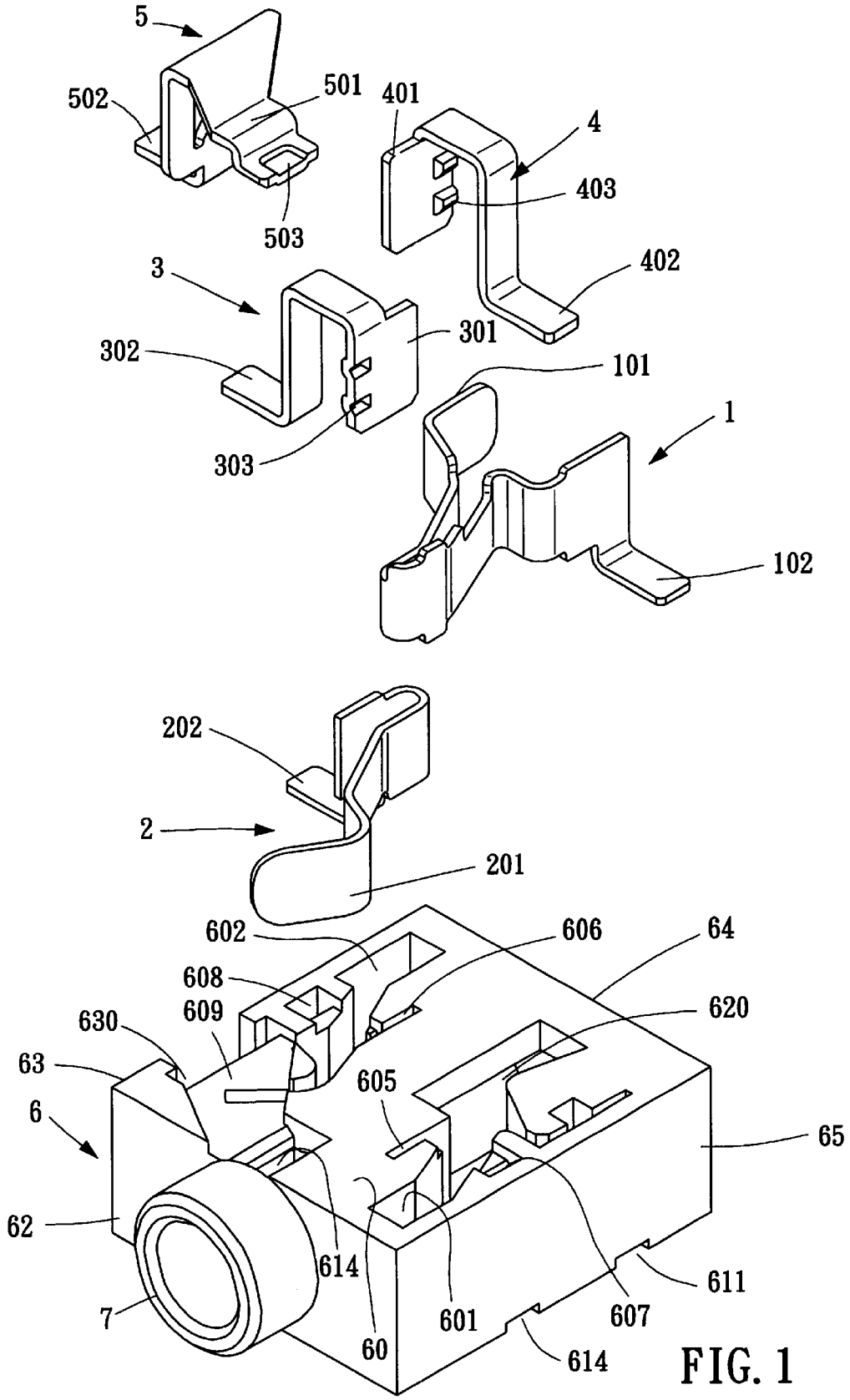
FIG. 1 is an exploded view of an audio jack constructed in accordance with the present invention.
Figure 2:
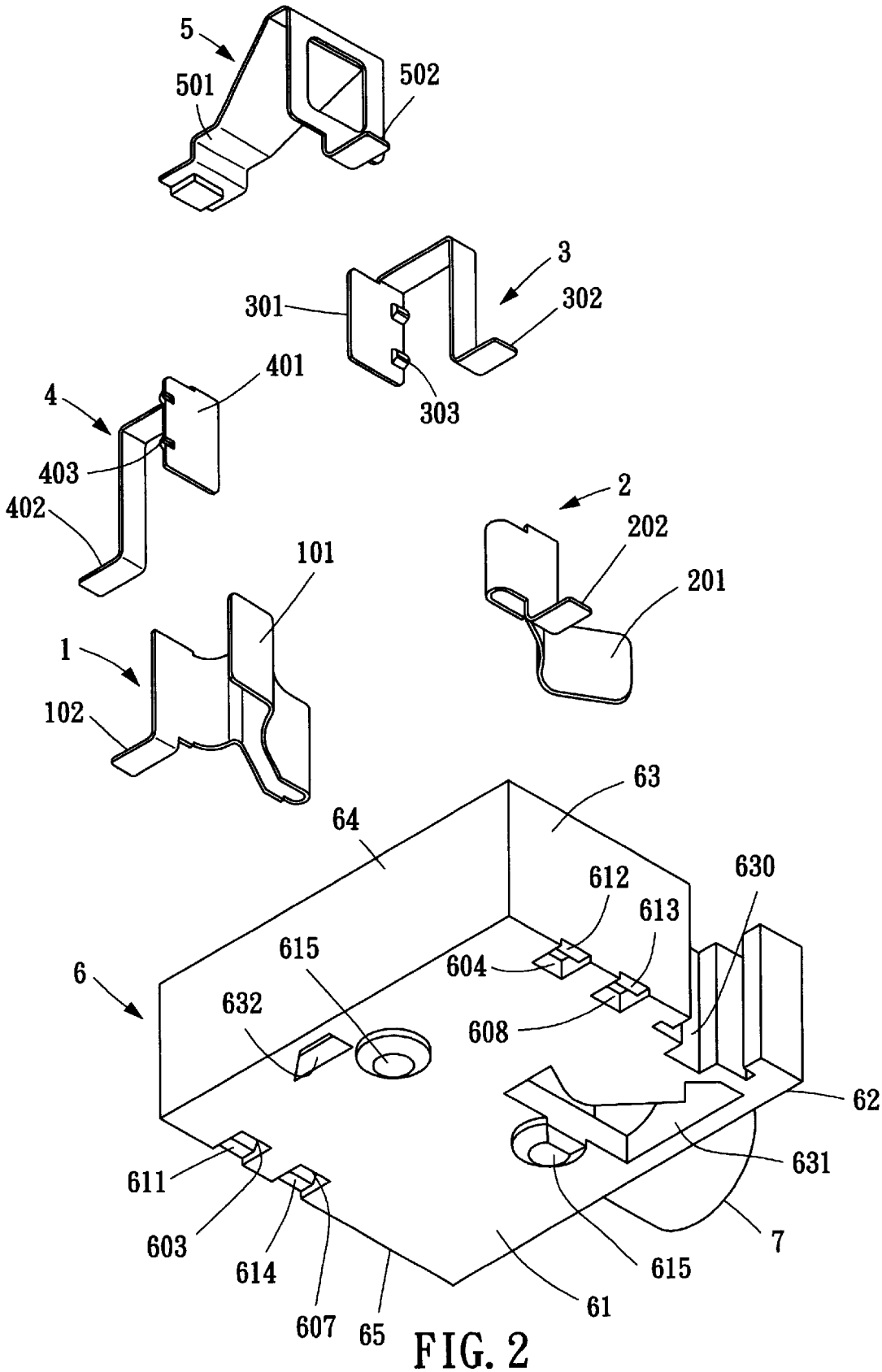
FIG. 2 is an exploded view of the audio jack of the present invention taken from a different perspective.

Referring to the drawings and in particular to FIGS. 1 and 2, wherein an audio jack constructed in accordance with the present invention is shown, the audio jack of the present invention comprises a nonconductive casing 6 inside which conductive terminal members 1, 2, 3, 4 and a grounding member 5 are disposed. The casing 6 has a top face 60 and a bottom face 61 connected by a front face 62, a rear face 64, a left face 63 and a right face 65. An interior space 620 is defined in the casing 6. The front face 62 has a plug receptacle 7 formed thereon and in communication with the interior space 620 for receiving a plug (not shown) for the transmission of audio signals.

The bottom face 61 of the casing 6 has positioning pins 615 formed thereon. The positioning pins 615 are receivable in holes defined in a substrate (such as a printed circuit board) for positioning purposes.

Figure 4:
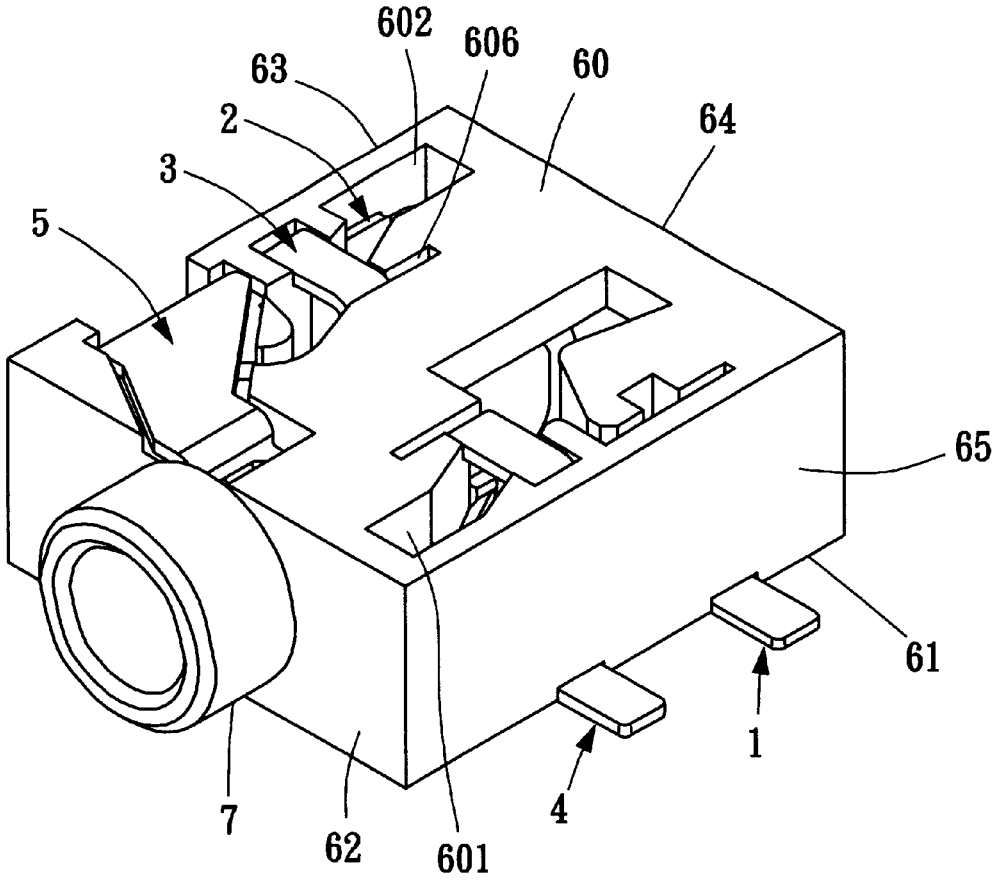
FIG. 4 is an assembled view of FIG. 1.

The casing 6 has two sets of slots defined on the top face 60 thereof. The first set includes a first movable terminal holding slot 601 and a first stationary terminal holding slot 605. The second set includes a second movable terminal holding slot 602 and a second stationary terminal holding slot 606. The movable terminal holding slots 601, 602 respectively receive and retain a first movable terminal member 1 and a second movable terminal member 2 therein, while the stationary terminal holding slots 605, 606 respectively receive and retain a first stationary terminal member 4 and a second stationary terminal member 3 therein (FIG. 4). All the terminal members 1, 2, 3, 4 are made of conductive material.

The first movable terminal member 1 is a U-shaped member capable of pre-compression in order to be fit in the first movable terminal holding slot 601. A reactive force facilitates retention of the first movable terminal member 1 in the first movable terminal holding slot 601. In this respect, the U shape of the first movable terminal member 1 is dimensioned to be larger than the width of the first movable terminal holding slot 601 thereby requiring pre-compression of the U shape of the first movable terminal member 1 before being fit into the slot 601.

Figure 3:
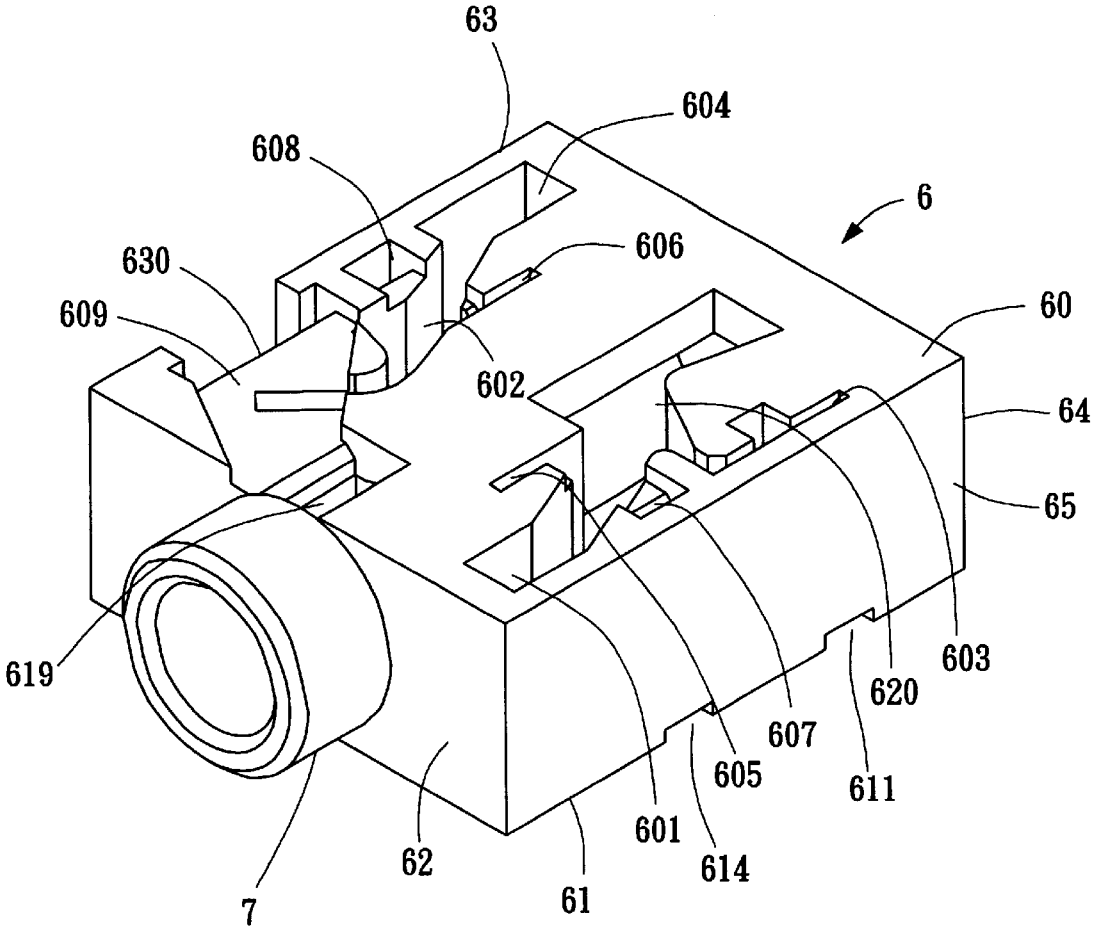
FIG. 3 is a perspective view of a casing of the audio jack of the present invention.

The U shape of the first movable terminal member 1 has a first limb and a second limb from which an internal contact section 101 and an external contact section 102 extend, respectively. The external contact section 102 extends out of the casing 6 though a channel 603 (FIGS. 2 and 3) defined in the casing 6. The internal contact section 101 of the first movable terminal member 1 extends into the interior space 620. The first limb of the first movable terminal member 1 is resilient and forms a deflectable arm thereby facilitating movement of the internal contact section 101.

The first stationary terminal member 4 comprises a U-shaped configuration, having a first limb forming an internal contact section 401 and a second limb having an external contact section 402 extending therefrom. The internal contact section 401 is received in the first stationary terminal holding slot 605. The first stationary limb of the second terminal member 4 extends through a channel 607 defined in the casing 6 whereby the external contact section 402 projects beyond the casing 6.

The first stationary terminal holding slot 605 is in communication with the first movable terminal holding slot 601. The internal contact section 101 of the first movable terminal member 1 is biased by the resiliency of the first limb thereof to engage with the internal contact section 401 of the first stationary terminal member 4. Preferably, the internal contact section 401 of the first stationary terminal member 4 comprises a plurality of projections 403 for facilitating physical and electrical engagement between the internal contact sections 101, 401 of the terminal members 1, 4. The first movable terminal member 1 is selectively separable and electrically disengageable from the first stationary terminal member 4.

The second movable terminal member 2 is a U-shaped member capable of pre-compression in order to be fit into the second movable terminal holding slot 602. The reactive spring force facilitates the securement of the second movable terminal member 2 in the second movable terminal holding slot 602. In this respect, the U shape of the second movable terminal member 2 is dimensioned to be larger than the width of the second movable terminal holding slot 602 thereby requiring a pre-compression of the U shape of the second movable terminal member 2 before being fit into the slot 602.

The U shape of the second movable terminal member 2 has a first limb from which an internal contact section 201 extends and a second limb from which an external contact section 202 extends. The external contact section 202 extends out of the casing 6 through a channel 604 (FIGS. 2 and 3) defined in the casing 6. The internal contact section 201 of the second movable terminal member 2 extends into the interior space 620. The first limb of the second movable terminal member 2 is resilient and forms a deflectable arm that causes the internal contact section 201 to be movable.

The second stationary terminal member 3 comprises a U-shaped configuration, having a first limb forming an internal contact section 301 and a second limb having an external contact section 302 extending therefrom. The internal contact section 301 is received in the second stationary terminal holding slot 606. The second limb of the second stationary terminal member 3 extends through a channel 608 defined in the casing 6 with the external contact section 302 thereof projecting beyond the casing 6.

The second stationary terminal holding slot 606 is in communication with the second movable terminal holding slot 602. The internal contact section 201 of the second movable terminal member 2 is biased by the resiliency of the first limb thereof to engage with the internal contact section 301 of the second stationary terminal member 3. Preferably, the internal contact section 301 of the second stationary terminal member 3 comprises a plurality of projections 303 for facilitating physical and electrical engagement between the internal contact sections 201, 301 of the terminal members 2, 3. The second movable terminal member 2 is selectively separable and electrically disengageable from the second stationary terminal member 3.

Since the internal contact sections 101, 201 of the first and second movable terminal members 1, 2 extend into the interior space 620, the plug contacts the internal contact sections 101, 201 of the first and second movable terminal members 1, 2 and deflects the first limbs thereof. Thus, the internal contact sections 101, 201 of the first and second movable terminal members 1, 2 are separated from the internal contact sections 401, 301 of the first and second stationary terminal members 4, 3.

Figure 7:
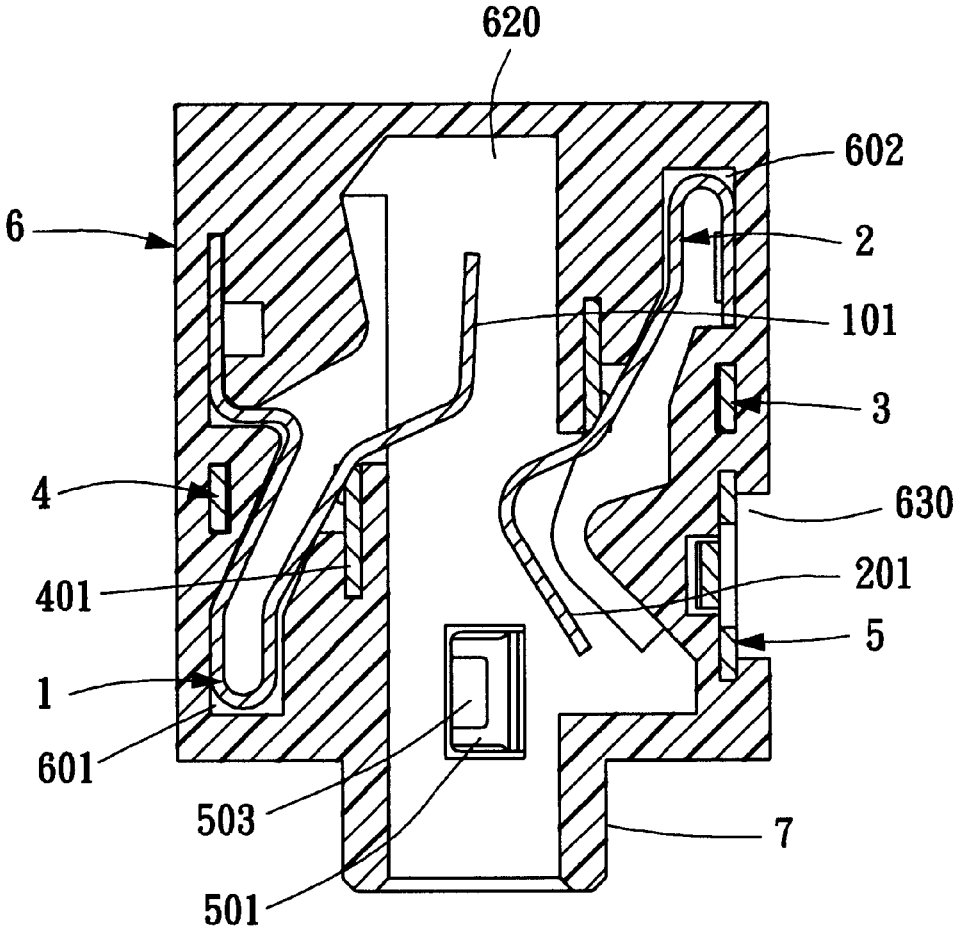
FIG. 7 is another cross-sectional view of the audio jack of the present invention observed from the bottom side.

The grounding terminal member 5 forms a U to shape fit over an internal wall 609 formed in the casing 6. The grounding terminal member 5 has an internal contact section 501 extending from a first limb of the U shape. The internal contact section 501 extends through a channel 619 (FIGS. 1 to 3) into the interior space 620 and is thus contactable by the plug. A projection 503 is formed on the internal contact section 501 of the grounding terminal member 5 and is positioned in the interior space 620 for contacting the plug (FIG. 7).

The grounding terminal member 5 also has a second limb from which an external contact section 502 extends. The external contact section 502 of the grounding terminal member 5 projects beyond the casing 6. Preferably a slot 630 is formed on the left face 63 of the casing 6 at a location corresponding to the internal wall 609 for receiving the second limb of the grounding terminal member 5 therein. The slot 630 is preferably T-shaped or dovetail-shaped for more securely retaining the second limb of the grounding terminal member 5 therein.

Figure 5:
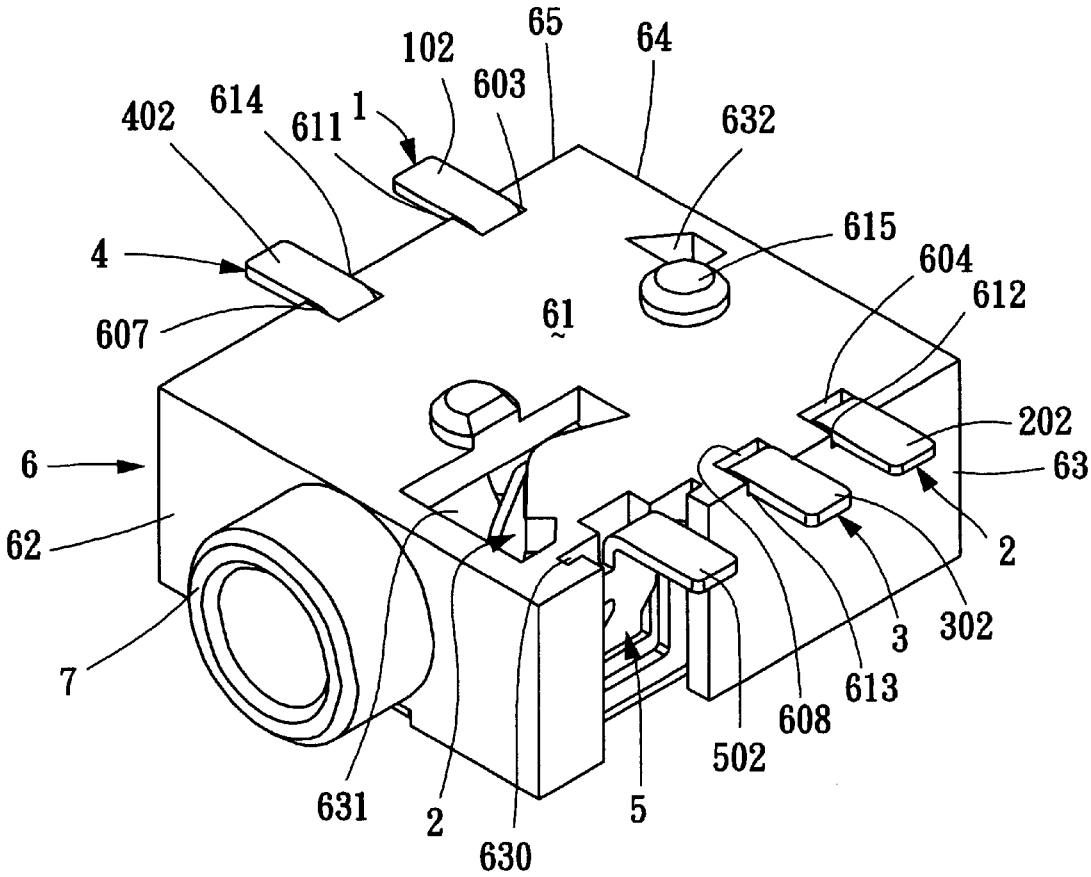
FIG. 5 is a bottom perspective view of FIG. 4.
Figure 6:
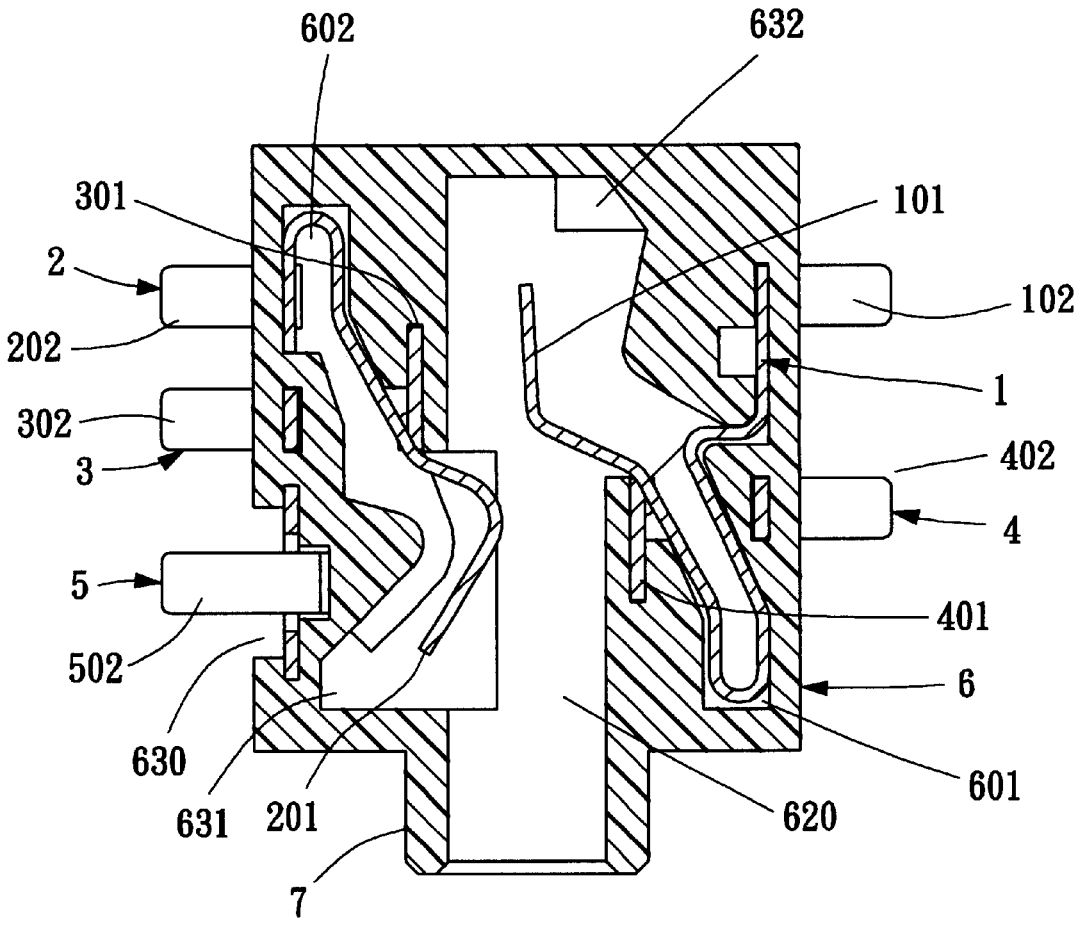
FIG. 6 is a cross-sectional view of the audio jack of the present invention observed from the top side.

The external contact sections 102, 202, 302, 402, 502 of the terminal members 1, 2, 3, 4, 5 each have an L-shaped configuration and project beyond the casing 6 at right angles (FIG. 5) for securely retaining the terminal members 1, 2, 3, 4, 5 in the casing 6 and preventing the terminal members 1, 2, 3, 4, 5 from becoming displaced with respect to the casing 6. The bottom face 61 defines four slots 611, 612, 613, 614 respectively communicating with the channels 603, 604, 608, 607 in the left and right faces 63, 65 of the casing 6 for accommodating the external contact sections 102, 202, 302, 402 of the terminal members 1, 2, 3, 4 (FIG. 5).

The bottom face 61 defines two openings 631, 632 therein in communication with the interior space 620. The openings 632, 631 are observing windows and allow a user to visually observe the contact engagement between the first and second movable terminal members 1, 2 and the first and second stationary terminal members 4, 3.

In the embodiment illustrated, the plug first contacts the grounding terminal member 5 during insertion. The plug is then brought into contact engagement with the internal contact sections 101, 201 of the first and second movable terminal members 1, 2. Thus, the internal contact sections 101, 201 of the first and second movable terminal members 1, 2 are separated from the internal contact sections 401, 301 of the first and second stationary terminal members 4, 3 thereby disconnecting the first and second movable terminal members 1, 2 from the first and second stationary terminal members 4, 3.

When removing the plug from the jack, the resiliency of the first limbs of the first and second movable terminal members 1, 2 allows the internal contact sections 101, 201 to resume engagement with the internal contact sections 401, 301 of the first and second stationary members 4, 3.

Although the present invention has been described with reference to a preferred embodiment thereof, it is apparent to those skilled in the art that there are a variety of modifications and changes that may be made without departing from the scope of the present invention which is intended to be defined by the appended claims.

What is claimed is:

1. An audio jack comprising:

a nonconductive casing defining therein an interior space adapted to receive a plug, the casing having a top face on which first and second sets of slots are formed in communication with the interior space, and a bottom face on which at least one observing window is formed, each set of slots comprising at least a movable terminal holding slot having a predetermined width; and first and second sets of conductive terminal members respectively corresponding to the first and second sets of slots, each set of conductive terminal members comprising at least a movable terminal member dimensioned to be larger than the predetermined width of the movable terminal holding slot, the movable terminal member being pre-compressible in order to be fit into and retained in the movable terminal holding slot by means of a reactive spring force of the pre-compression thereof;

wherein each set of slots further comprises a stationary terminal holding slot in communication with the movable terminal holding slot and wherein each set of conductive terminal members further comprises a stationary terminal member received in the corresponding stationary terminal holding slot and being contact-engageable by the movable terminal member;

said observing window being in a position that allows a user to see the engaging situation between one of the movable terminal member and a corresponding stationary terminal member.

2. The audio jack as claimed in claim 1, wherein the stationary terminal member comprises an internal contact section and wherein the movable terminal member comprises a deflectable arm supporting thereon an internal contact section which engages the internal contact section of the stationary terminal member, the deflectable arm partially extending into the interior space.

3. The audio jack as claimed in claim 2, wherein the casing comprises a plug receptacle in communication with the interior space adapted to receive a plug which is insertable into the interior space and is brought into contact engagement with the deflectable arm thereby separating the internal contact sections of the movable and stationary terminal members.

4. The audio jack as claimed in claim 2, wherein the internal contact section of the stationary terminal member comprises projections thereon for facilitating engagement with the internal contact section of the movable terminal member.

5. The audio jack as claimed in claim 2, wherein each of the terminal members comprises an external contact section extending beyond the casing and adapted to electrically engage with an external member.

6. The audio jack as claimed in claim 5, wherein the external contact sections extend beyond the bottom face, the bottom face comprising a slot for accommodating each of the external contact sections.

7. The audio jack as claimed in claim 1, wherein a plurality of positioning pins are formed on bottom face of the casing.

8. The audio jack as claimed in claim 1 further comprising a grounding terminal member having an internal contact section extending into the interior space and being engageable by the plug.

9. The audio jack as claimed in claim 8, wherein the internal contact section of the grounding terminal member comprises a projection for facilitating engagement with the plug.

* * * * *